US005078188A

United States Patent [19]

Nitzberg et al.

[11] Patent Number: 5,078,188

[45] Date of Patent: * Jan. 7, 1992

[54] FLOW RATE LIMITING DEVICE FOR AN AUTOMATIC SHUT-OFF LIQUID DISPENSING NOZZLE

[75] Inventors: Leonard R. Nitzberg; Paul D. Manhardt, both of Knoxville, Tenn.

[73] Assignee: Helix, Enterprises, Inc., Knoxville, Tenn.

[ * ] Notice: The portion of the term of this patent subsequent to Aug. 14, 2007 has been disclaimed.

[21] Appl. No.: 529,889

[22] Filed: May 29, 1990

Related U.S. Application Data

[63] Continuation of Ser. No. 40,278, Apr. 20, 1987, Pat. No. 4,947,905, which is a continuation-in-part of Ser. No. 21,399, Mar. 4, 1987, Pat. No. 4,951,722.

[51] Int. Cl.[5] ..... B65B 1/30

[52] U.S. Cl. ..... 141/207; 141/192

[58] Field of Search ..... 141/192, 198, 206-229; 137/117, 499, 504; 251/16

[56] References Cited

U.S. PATENT DOCUMENTS 2,388,852 11/1945 Killman ..... 141/215

*Primary Examiner*—Charles E. Phillips
*Assistant Examiner*—David J. Walczak
*Attorney, Agent, or Firm*—Alan Ruderman

[57] ABSTRACT

An automatic shut-off duel dispensing nozzle with a flow rate limiting mechanism. The nozzle includes a valve which controls the flow of fuel through a passage leading from the nozzle inlet to the nozzle outlet which is normally connected to a spout. This valve is responsive to a manually operable lever and to a vacuum operated release mechanism which automatically shuts the flow of fuel through the nozzle off when the level of fuel in a tank reaches a preselected level or when the flow of fuel through the nozzle reaches a preselected threshold rate of flow.

8 Claims, 2 Drawing Sheets

FLOW RATE LIMITING DEVICE FOR AN AUTOMATIC SHUT-OFF LIQUID DISPENSING NOZZLE

REFERENCE TO RELATED APPLICATIONS

This application is a Continuation of United States patent application Ser. No. 07/040,278 filed Apr. 20, 1987, now U.S. Pat. No. 4,947,905 dated Aug. 14, 1990, which is a Continuation-In-Part of United States patent application Ser. No. 07/021,399 filed Mar. 4, 1987, now U.S. Pat. No. 4,951,722 dated Aug. 28, 1990.

BACKGROUND OF THE INVENTION

This invention relates to fuel dispensing nozzles, and more particularly concerns a device for limiting the rate of flow of fuel through an automatic shut-off fuel dispensing nozzle, such that it is prevented from exceeding a preselected threshold flow rate.

Liquid and fuel dispensing nozzles are commonly used to dispense gasoline or other fuels into fuel tanks of motorized vehicles. Conventional dispensing nozzles include a nozzle body defining an internal flow passage extending between the nozzle inlet and its outlet. The inlet of the nozzle is connected to a supply hose which feeds a liquid such as pressurized gasoline or other fuel to the nozzle. This pressurized fuel passes through the internal flow passage to an outlet which consists of, or is connected to, a spout which serves as the discharge end of the nozzle. The spout is inserted into the neck of a motorized vehicle's fuel tank during filling operations. The pressurized fuel flow through the internal fuel passage is conventionally controlled by a valve which is actuated by a manually operated valve lever selectively depressed by the nozzle user during dispensing operations. Moreover, automatic shut-off nozzles serve to automatically close the flow valve when the level of the liquid in the tank (or a neck leading thereto) being filled reached a preselected level. This is normally accomplished by actuation of a vacuum operated release mechanism mechanically coupled with the flow valve.

Fuel, under pressure created by a pump, is fed through the nozzle at flow rates established by the pump capacity and the extent to which the valve lever is actuated. It has been found that the rapid flow rates capable of being generated by conventional fuel pumps feeding the nozzle produce gasoline or other fuel fumes which escape into the atmosphere. Due to the wide spread use of dispensing nozzles and the volume of fumes escaping during dispensing operations, government regulations have been passed which are designed to limit the rate of flow of fuel through the dispensing nozzle. By limiting the rate of flow, the amount of fumes escaping can be reduced to a level which is less likely to cause significant damage to the earth's atmosphere.

SUMMARY OF THE INVENTION

Accordingly, it is an object of the present invention to provide a flow rate limiting device and method for an automatic shut-off fuel dispensing nozzle and which serves to limit the rate of flow of fuel through the nozzle.

It is another object of the present invention to provide a flow rate limiting device and method which can be readily installed in existing automatic shut-off dispensing nozzles to place them in compliance with government regulations.

It is also an object of the invention to provide a flow rate limiting device which can be readily manufactured and easily maintained.

Other objects and advantages will be obvious to those skilled in the art, and will in part appear hereinafter and be accomplished by the present invention which provides an automatic shut-off fuel dispensing nozzle with a flow rate limiting device. The nozzle includes an inlet through which a liquid such as fuel is supplied to the nozzle from a supply hose and an outlet. An internal flow passage provides fluid communication and a path along which fuel flows between said inlet and said outlet. A spout communicates with the outlet and is capable of being inserted into a tank through an opening therein or into a neck leading to the tank for dispensing fuel. A valve is mounted in the nozzle body and controls the flow of liquid through the passage. The opening and closing of the valve is accomplished manually as by a lever. A vacuum generated device is positioned proximate the flow passage and develops a vacuum of a magnitude proportionate to the rate of flow of liquid in the nozzle. This vacuum generating device is mounted in fluid communication with a vacuum operated release mechanism which releases the manually operated lever to close the valve and shut off the liquid flow through the nozzle when the vacuum magnitude reaches a preselected threshold level. The operation of the release means is controlled by a vacuum relief system which prevents the vacuum developed proximate the release mechanism from reaching a triggering magnitude unless one of the following conditions occurs: (1) the fuel in the tank rises to a level which constricts a vacuum relief opening at the external surface of the spout; (2) the relief opening at the external surface of the spout is restricted due to air turbulence created in the neck of the tank by displacing air with fuel during the filling operation; or (3) the flow rate of fuel through the nozzle creates a vacuum of such magnitude that the relief mechanism is unable to provide adequate relief thereof and thus a vacuum is generated proximate the release mechanism which has a magnitude sufficient to trigger the release mechanism and automatically shut off the fuel flow to the nozzle.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENTS

Figures 1, 2:
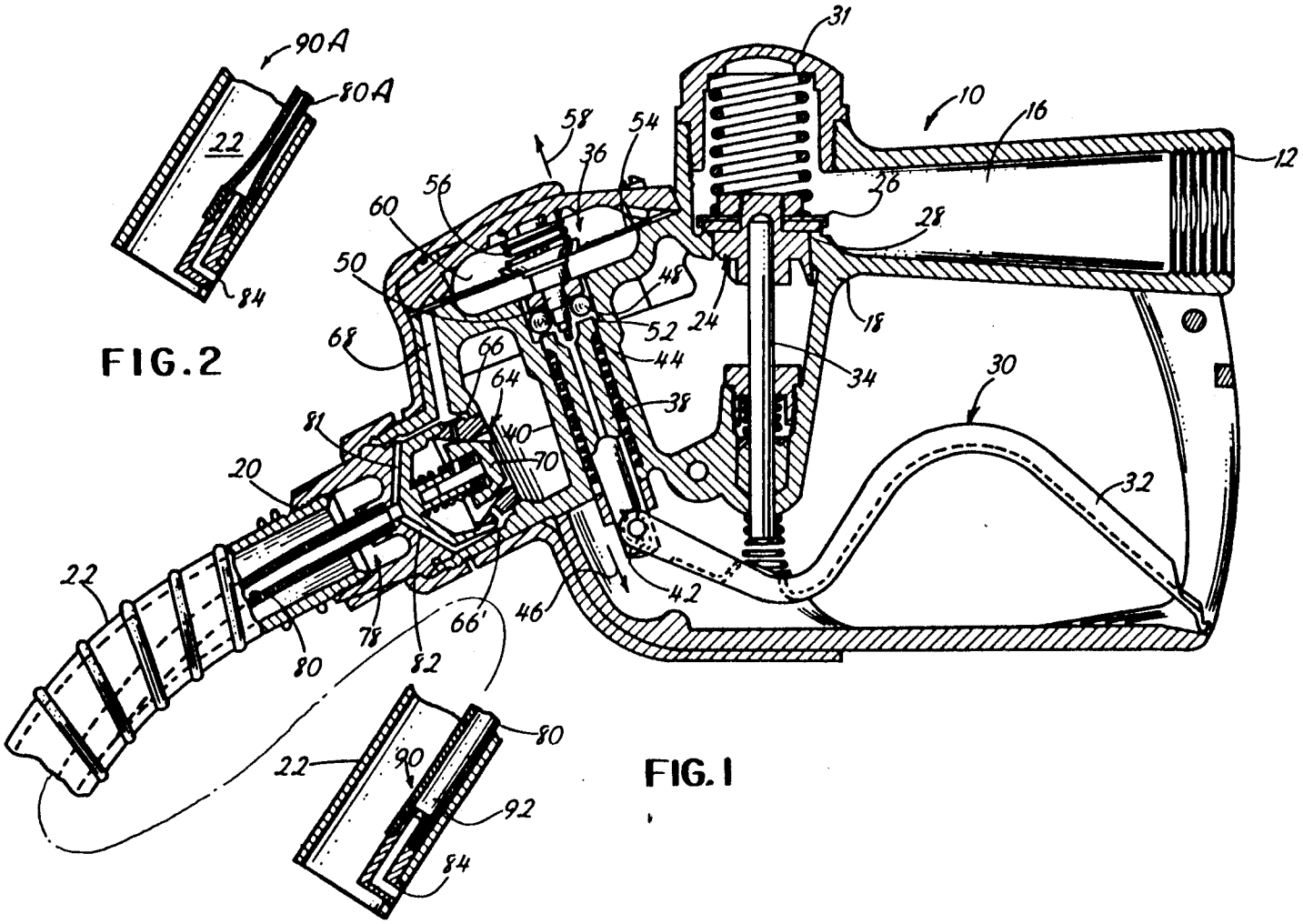
FIG. 1 is a sectional side elevation view of an automatic shut-off dispensing nozzle constructed in accordance with various features of the present invention.
FIG. 2 is a sectional view of a flow rate limiting device wherein vacuum relief is limited by a relief tube having an orifice of a predetermined size.

Referring now to the drawings, an automatic shut-off fuel dispensing nozzle constructed in accordance with various features of the present invention is illustrated generally at 10 in FIG. 1. This nozzle includes an inlet 12 which is mounted in fluid communication with a suitable supply hose (not shown) or the like which supplies pressurized liquid or fuel such as gasoline to the nozzle 10. This fuel is pressurized by the action of a pump mounted at a remote location from the nozzle 10. The fuel flows from the hose through a conventional attachment means or coupling into the inlet 12 of the nozzle and enters the internal flow passage 16. This passage 16 extends through the body 18 of the nozzle 10. The internal flow passage 16 terminates at the outlet 20 which normally comprises, or is connected in fluid communication to, a spout 22 through which fuel is dispensed into the fuel tank of a motorized vehicle or the like.

The flow of fuel through the internal flow passage 16 is controlled in an automatic shut-off nozzle such as shown in FIG. 1 by a valve 24. This valve 24 is mounted such that when the valve member 26 rests on the valve seat 28 the flow of liquid through the internal flow passage 16 is prohibited. Upon manual operation of the valve control or lever 30, the valve member 26 is moved against the biasing force of the spring 31 thus opening the internal flow passage 16 such that the pressurized fuel can flow therethrough. When the manual control lever 30 is released, the spring 31 biases the valve member 26 towards the seat 28 and thus closes the internal flow passage and terminates the flow of fuel therethrough. More specifically, it will be noted in FIG. 1 that the manual control lever 30 comprises a valve lever 32 which engages the rod 34 for moving the valve member 26 away from the valve seat 28 to allow fuel to flow through the internal flow passage which terminates in the spout 22.

An important feature of an automatic shut-off nozzle of conventional design (such as is shown in U.S. Pat. No. 3,653,415 incorporated by reference) is to provide a mechanism for automatically terminating the flow of liquid through the nozzle when the fuel or liquid in the tank (or neck leading thereto) being filled reaches a preselected level which causes constriction of an opening on the spout. To this end, a vacuum operated release means is provided generally at 36. The illustrated vacuum operated release means 36 comprises a plunger 38 which is slidably mounted in the body portion 40 of the nozzle body 10. This plunger is pivotally connected at its outward end portion 42 to the lever 32. Spring 44 serves to bias the plunger 38 in the direction of the arrow 46. The plunger 38 is held in the position shown in FIG. 1 by a detent mechanism 48. The detent mechanism of conventional design comprises a plurality of balls, shown in FIG. 1, which are forced outwardly in a radial direction from the longitudinal axis of the plunger 38 by member 50. It will be noted that these balls comprising the detent member 48 engage the shoulder 52 of the bore in the nozzle body 18 which receives the plunger 38 such that this plunger 38 can not move in the direction of the arrow 46 when the balls are forced radially outwardly by the member 50. This member 50 is connected to a diaphram 54 which is spring biased by the spring 56 in the direction of the arrow 46. When the diaphram is pulled upwardly in the direction of the arrow 58 the member 50 is removed from the location between the detent mechanism or balls 48 and allows the plunger, under the biasing force of this spring 44 to move in the direction of the arrow 46. This releases the mechanical connection between the lever 32 and the rod 34 and automatically causes the valve 24 to close. Thus, the negative pressure or vacuum generated in the chamber 60 above the diaphram 54 serves to control the automatic shut-off operation of the valve 24 to terminate the flow of liquid through the passage 16.

The vacuum which serves to trigger the vacuum operated release mechanism 36 is generated by a venturi vacuum generating mechanism 64 shown in FIG. 1. This venturi vacuum generating mechanism 64 is of substantially conventional design and is positioned in the passage 16 extending between the inlet 12 and the outlet 20. More specifically, the mechanism 64 defines at least one venturi port 66 (another port 66' is shown in FIG. 1) past which liquid flows under pressure. A venturi vacuum is generated in these venturi ports which are positioned in fluid communication with the chamber 60 above the diaphram 54 through the connected conduits on ports 82, 81 and 68 as shown in FIG. 1. Thus, the negative pressure or vacuum generated in the venturi ports 66 and 66' communicate with the chamber 60 and serves to pull the diaphram 54 in the direction of the arrow 58. As shown in FIG. 1, a spring biased check valve 70 is positioned proximate the venturi openings 66 and 66' to enhance the development of the negative pressure generated by the venturi vacuum generating means 64. It will be noted that this check valve 70 is moved in a direction down stream as fuel flows through the nozzle to allow ready flow of the fuel past the ports 66 and 66'.

The vacuum generated by the flow of fuel pass the venturi ports 66 and 66' is normally relieved by a vacuum relief means generally indicated at 78 in FIG. 1. This vacuum relief means 78 serves to relieve the vacuum generated by the venturi vacuum generating means 64 and in this connection, includes a conduit 80 which is mounted in fluid communication with conduit 81 and 82 which connect the vacuum relief ports to conduit 68. Conduit 80 extends along a portion of the length of the spout 22 as shown in FIG. 1 and terminates at an opening 84 on the surface of the spout 22. The location of this opening 84 is such that it is normally positioned in the tank, or a conduit leading to the tank, which is filled during dispensing operations. As shown in FIG. 1, the opening provides fluid communication between the ambient atmosphere and the vacuum release mechanism 66, or more specifically, the chamber 60 above the diaphram 54.

Thus, vacuum generated by the venturi vacuum generating mechanism 64, which is proportionate to the rate of flow past this means 64, is relieved through the opening 84 such that the release mechanism 36 is not actuated during normal dispensing operations. In the event the opening 84 is constricted as by the level of liquid in the tank rising above the opening 84, the magnitude of the vacuum generated in the chamber 60 reaches a level which serves to move the detent 50 in the direction of the arrow 58 and thereby causing an automatic shut-off of the flow of fuel through the passage 16 as has been described above.

An important feature of the present invention is to provide a flow rate limiting mechanism generally indicated at 90 in FIG. 1 which serves as a triggering device to operate the vacuum operated release mechanism 36 for shutting off the flow of liquid through the nozzle when the flow rate of the liquid reaches a preselected threshold flow rate. To this end the flow rate limiting mechanism generally indicated at 90 in FIG. 1 includes a member 92 which serves as a restricted orifice for limiting the flow of the air which serves to relieve the vacuum generated by the means 64. It will be recognized by those skilled in the art that the size and shape of the orifice defined by the member 92, and of the member 92, can vary. In the preferred embodiment, this orifice will be designed such that the relief means 78 will become ineffective (inadequate to provide relief for the vacuum developed in chamber 60) thereby causing actuation of the vacuum operated release mechanism 36 in the event the flow of fuel past the venturi vacuum generating mechanism 64 reaches a preselected flow rate (such as ten gallons per minute as is anticipated to be required by government regulations).

Alternate embodiments of flow rate limiting mechanisms which serve as triggering devices to operate the vacuum operated release mechanism 36 are shown in FIGS. 2–7 which will be described in turn. It will be noted in each of these Figs., the triggering devices 90 A–F are each mounted in the spout 22 at a location such that the devices can interrupt the flow of air through the conduit 80, which serves as a portion of the vacuum relief system and, provides fluid communication with the external surface of the spout 22 through the opening 84. It will also be noted in FIGS. 2–7 that the particular shape of the conduit 80 can vary in order to accommodate the configuration of, and provide fluid communication with, the flow rate limiting mechanisms 90 A–F.

Referring now to FIG. 2, the flow rate limiting mechanism 90A is the conduit 80A which is, by design, of sufficiently small diameter and of such length as to restrict the flow of air through the relief means 78. This prohibits the relief means 78 from providing proper relief for the vacuum developed in the chamber 60 in the event the flow of fuel past the venturi vacuum generating mechanism 64 reaches a preselected flow rate.

Figure 3:
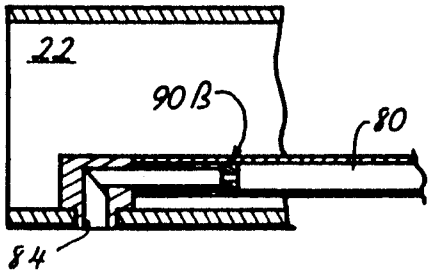
FIG. 3 illustrates a sectional view of a flow rate limiting device which constricts the magnitude of the air flow capable of relieving the vacuum generated by the venturi vacuum generating device.

Referring now to FIG. 3, the flow rate limiting mechanism 90B is of substantially cylindrical configuration and defines an orifice therethrough having a substantially circular cross-sectional outline. The shape of the orifice defined in the mechanism 90B is designed to trigger the vacuum operated release mechanism 36 by restricting the flow of air through the relief means or system 78 such that the mechanism 36 is triggered when the flow of fuel through the passage 16 reaches a preselected threshold rate.

Figure 4:
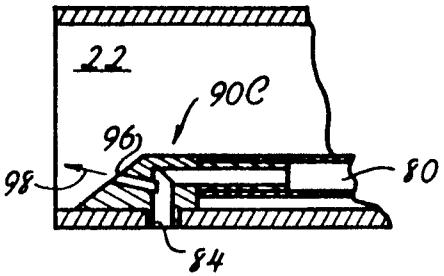
FIG. 4 illustrates an alternate embodiment of a flow rate limiting device employing a counter-acting venturi vacuum generating mechanism.

The embodiment shown in FIG. 4 incorporates a venturi port 96 which serves to counteract the flow of air through the release system 78 and more specifically the conduit 80. This relief port 96 is responsive to the flow of liquid through the spout 22. When this flow rate reaches a preselected threshold rate, the negative pressure drawn through the venturi port 96 in the direction of the arrow 98 limits the rate of flow of air through the relief system 78. Thus, after the flow rate through the spout 22 reaches a preselected rate the vacuum operated release mechanism 36 will be actuated as is described in greater detail hereinabove.

Figure 7:
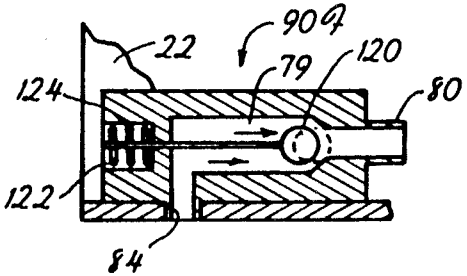
FIG. 7 illustrates an alternate embodiment of a flow rate limiting device having a valve which restricts the flow of air through the vacuum relief system and responds to the rate or magnitude of such flow.
Figure 6:
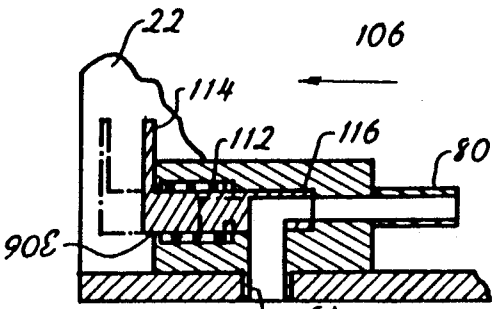
FIGS. 5-6 disclose different embodiments of valve mechanisms which selectively restrict the flow of air through the vacuum relief system.
Figure 5:
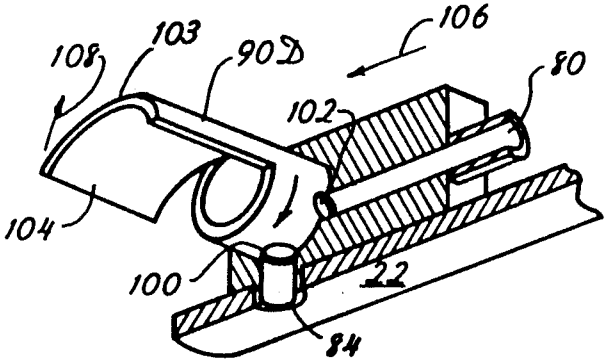

FIGS. 5–7 disclose various embodiments of devices for limiting the flow of air through the vacuum release system 78 or more specifically the conduit 80 in response to valves which are actuated by the flow. In FIGS. 5, 6 the valves are actuated by the flow of liquid through the spout 22. In FIG. 7 the valve is actuated by the flow of air through the flow passage 79 of the relief means 78.

FIG. 5 illustrates a flow rate limiting mechanism 90D which allows the flow of air through the opening 84 and through the conduit 80 when the valve openings 100 and 102 register with the opening 84 and the conduit 80 as is shown in FIG. 5. The flow of liquid through the spout 22 acts upon the air foil portion 103 of valve member 104 which extends into the spout 22. This causes the mechanism 90D to rotate for selectively opening and closing the passage or flow of air through the conduit 80. This member 90D is designed such that air flows through the conduit 80 until the flow of liquid in the direction of the arrow 106 exceeds a preselected threshold level at which point lift in the direction of the arrow 108 will cause rotation of the mechanism 90D and blockage of the conduit 80. When flow is terminated, the valve is urged into the open position either by gravity or suitable biasing means such as a spring.

FIG. 6 illustrates an alternate embodiment of a flow rate limiting mechanism responsive to the flow of fuel through the spout 22 in the direction of the arrow 106. Until the flow exceeds a preselected threshold rate, the member or mechanism 90E is spring biased to the position shown in FIG. 6. As the fuel flow acts against member 114, this member moves in the direction of the arrow 106 against the urging of the spring 112 until section 116 of the mechanism 90E blocks the opening through the conduit 80 and terminates the flow of air through the vacuum release system 78 thereby operating the release mechanism 36.

The flow rate limiting mechanism 90F shown in FIG. 7 serves to terminate the flow of relief air through the conduit 80 and is responsive to this flow of air after it reaches a preselected threshold rate proportionate to the threshold rate of flow of fuel through the passage 16. More specifically, this mechanism 90F includes a member 120 which is mounted on a spring 122 connected to the support 124. When the flow of air through the conduit 80 exceeds a preselected threshold level the member 120 moves to the location of the phantom line thereby terminating the flow of fuel through conduit 80.

From the foregoing detailed description, it will be recognized by those skilled in the art that an improved automatic shut-off dispensing nozzle has been provided with a flow rate limiting device. This device is designed to automatically shut-off the flow of fuel or other liquid through the nozzle when a preselected rate of flow has been reached. This automatic shut-off feature incorporates a flow rate limiting mechanism having various embodiments which can be responsive to the flow of fuel through the nozzle and/or responsive to the flow of relief air drawn into the nozzle through a vacuum relief system. Further, the flow rate limiting mechanism can be readily installed and can be easily maintained.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. An automatic shut-off fuel dispensing nozzle with a volumetric flow rate limiting means, said nozzle comprising:

a body having an inlet through which a liquid fuel is supplied to said nozzle within a range of supply pressures, and an outlet through which said fuel is discharged, said body defining an internal flow passage along which said fuel flows from said inlet to said outlet;

a spout communicating with said outlet and capable of being inserted into a tank through a tank opening therein for dispensing said fuel, said spout being provided with a vacuum relief opening on the exterior of said spout at a location normally positioned within said tank during dispensing operations;

a valve mounted in said body for controlling the flow of liquid through said passage from a zero flow rate to a maximum flow rate;

a manually operated means controlling the operation of said valve such that fuel flows through said nozzle only when said valve is opened;

a venturi vacuum generating means positioned within said flow passage for developing a vacuum of magnitude proportionate to the rate of fuel past said vacuum generating means;

a vacuum operated release means mounted in fluid communication with said vacuum generating means for sensing the vacuum generated by said vacuum generating means and serving to release said manually operated means to close said valve for automatic shut-off of the fuel flow through said nozzle when the vacuum magnitude sensed by said release means reaches a preselected threshold level;

a vacuum relief conduit in fluid communication with said vacuum relief opening for providing fluid communication between the ambient atmosphere and said vacuum generating means and said release means, and adapted to automatically operate the vacuum operated release means when the level of fuel being dispensed into said tank constricts said vacuum relief opening, whereby the vacuum generated by said vacuum generating means is not relieved and acts against said release means to cause an automatic shut-off of liquid flowing through said passage; and volumetric fuel flow rate limiting means for reducing the cross-sectional area in the vacuum relief conduit to restrict said conduit from communicating sufficient amounts of ambient atmosphere in relief of said threshold level with said vacuum generating means after the volumetric flow rate of fuel reaches a predetermined rate less than said maximum flow rate so that said vacuum thereafter generated by said vacuum generating means communicates with said vacuum operated release means thereby to release said manually operated means to close said valve and shut-off fuel flow to said nozzle, said fuel rate limiting means being independent of the fuel supply pressure in said range and being insensitive to the position of said nozzle.

2. The fuel dispensing nozzle of claim 1, wherein said vacuum relief conduit defines a first cross-sectional area and said flow rate limiting means comprises means mounted in said vacuum relief conduit defining a second cross-sectional area smaller than said first cross-section area.

3. The fuel dispensing nozzle of claim 2, wherein said flow rate limiting means comprises a flow restricting member mounted in said vacuum relief conduit, said flow restricting member being provided with an orifice therethrough, said orifice defining a second cross-sectional area smaller than said first cross-sectional area, whereby said flow restricting member partially occludes said vacuum relief conduit for reducing the capacity of said conduit to relieve the vacuum generated by said venturi vacuum generating means.

4. The fuel dispensing nozzle of claim 1, wherein said flow rate limiting means comprises a second venturi generating means provided with a venturi port for establishing fluid communication between said vacuum relief conduit and the interior of said spout, whereby said second venturi generating means, in response to the flow of said liquid through said spout generates a vacuum communicated to said conduit through said venturi port thereby restricting the capacity of said vacuum relief means to relieve said vacuum generated by said first venturi generating means.

5. The fuel dispensing nozzle of claim 1, wherein said flow restricting means comprises a flow restricting member movably mounted in said conduit, said restricting member being movably responsive to ambient air drawn into said conduit through said vacuum relief opening from a first position to a second position whereby movement of said restricting member toward said second position reduces the effective cross-sectional area of said conduit.

6. The fuel dispensing nozzle of claim 5, wherein said flow restricting means further includes biasing means for biasing said restricting member toward said first position.

7. The fuel dispensing nozzle of claim 6, wherein said biasing means comprises a spring.

8. The fuel dispensing nozzle of claim 1, wherein said volumetric fuel flow rate limiting means restricts said conduit from communicating ambient atmosphere with said vacuum generating means when said fuel flow through said nozzle reaches approximately 10 gallons per minute and the level of fuel in said tank does not constrict said relief opening.

* * * * *